US008481237B2

(12) United States Patent
Wu et al.

(10) Patent No.: US 8,481,237 B2
(45) **Date of Patent: *Jul. 9, 2013**

(54) PHOTOCONDUCTOR OVERCOAT LAYER

(75) Inventors: Jin Wu, Pittsford, NY (US); Kenny-tuan T. Dinh, Webster, NY (US); Lanhui Zhang, Webster, NY (US); Marc J. Livecchi, Rochester, NY (US); Edward C. Savage, Webster, NY (US); Lin Ma, Pittsford, NY (US); David M. Skinner, Rochester, NY (US); Linda L. Ferrarese, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 264 days.

This patent is subject to a terminal disclaimer.

(21) Appl. No.: 13/012,302

(22) Filed: Jan. 24, 2011

(65) Prior Publication Data

US 2012/0189949 A1 Jul. 26, 2012

(51) Int. Cl.
*G03G 5/00* (2006.01)

(52) U.S. Cl.
USPC ..... 430/66

(58) Field of Classification Search
USPC ..... 430/66
See application file for complete search history.

(56) References Cited

U.S. PATENT DOCUMENTS

| | | | |
|---|---|---|---|
| 4,464,450 | A | 8/1984 | Teuscher |
| 4,921,773 | A | 5/1990 | Melnyk et al. |
| 7,715,742 | B2 | 5/2010 | Burry et al. |
| 7,745,082 | B2 | 6/2010 | Belknap et al. |
| 7,799,495 | B2 | 9/2010 | Wu et al. |

*Primary Examiner* — Mark A Chapman
(74) *Attorney, Agent, or Firm* — Hoffman Warnick LLC

(57) ABSTRACT

A photoconductor containing a photogenerating layer, and at least one charge transport layer, and an overcoat layer in contact with, and contiguous to the charge transport layer. The overcoat layer is comprised polyethylene-block-polyethylene glycol copolymer and a charge transport component.

20 Claims, 2 Drawing Sheets

PHOTOCONDUCTOR OVERCOAT LAYER

BACKGROUND

1. Field of Use

This disclosure is generally directed to layered imaging members, photoreceptors, photoconductors, and the like.

2. Background

Xerographic reproduction apparatus use a photoreceptor in the form of a drum in the creation of electrostatic images upon which toner is deposited and then transferred to another drum or belt. Photoreceptor drums are in contact with charging rollers. The charging rollers charge the photoreceptor. This contact between the photoreceptor and the charging rollers can create torque and wear issues with the charging rollers. It would be desirable to minimize such torque and wear issues.

In addition, it would be desirable to have formulations for overcoat layers of photoconductors that are stable for long period of times. Typical overcoat formulations tend to agglomerate if left standing for long periods of times. When this occurs extra milling and ultrsonication processes are required to return the overcoat formulation to proper specification.

SUMMARY

Disclosed herein is a photoconductor comprising an optional supporting substrate, a photogenerating layer, a charge transport layer, and an overcoat layer in contact with and contiguous to said charge transport layer. The overcoat layer is comprised of polyethylene-block-polyethylene glycol copolymer and a charge transport component.

Disclosed herein is a photoconductive member comprised in sequence of a substrate, a photogenerating layer, and at least one charge transport layer comprised of at least one charge transport component, and wherein said photogenerating layer is comprised of at least one photogenerating pigment, and an overcoat layer in contact with and contiguous to said charge transport layer. The overcoat layer is comprised of polyethylene-block-polyethylene glycol copolymer and a charge transport component.

Disclosed herein is a photoconductor comprising a supporting substrate, a photogenerating layer, a hole transport layer and an overcoat layer. The photogenerating layer is comprised of at least one photogenerating pigment, and wherein said photogenerating layer and said hole transport layer include a resin binder. The photogenerating layer is situated between the substrate and the hole transport layer. The overcoat layer is in contact with and contiguous to the hole transport layer, and the overcoat layer is comprised of a polyethylene-block-polyethylene glycol copolymer is represented by;

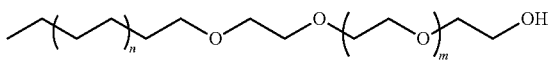

wherein n is from about 10 to about 23 and m is from about 0 to about 39, and a charge transport component.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
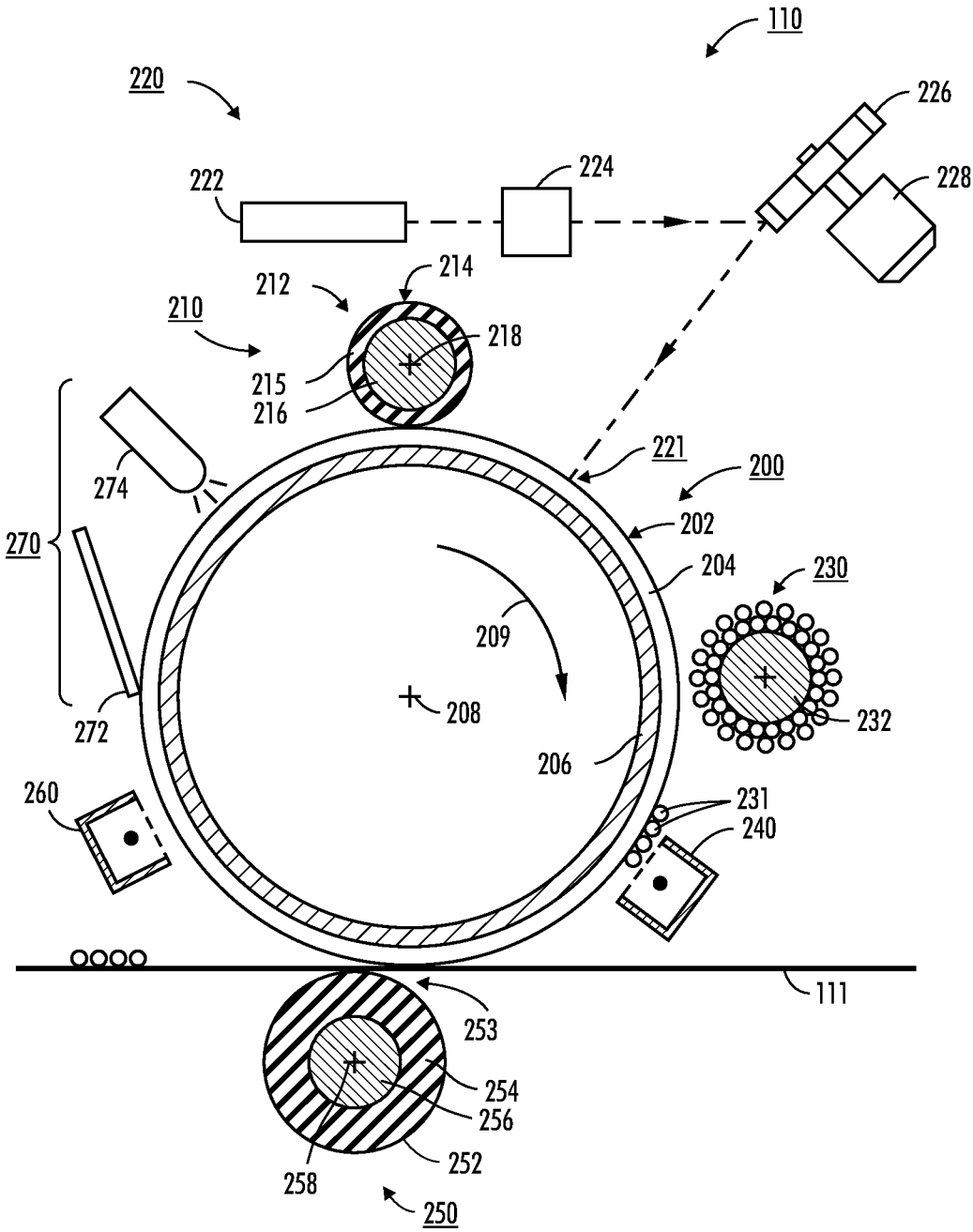
FIG. 1 is a schematic of an imaging apparatus in which embodiments can be employed.

It should be noted that some details of the figures have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Referring to an image forming apparatus 110 as an example, the image forming apparatus 110 (shown in FIG. 1) includes a photoreceptor 200 (PC), a charging station or subsystem 210, a laser scanning device or subsystem 220, such as a rasterizing output scanner (ROS), a toner deposition station or subsystem 230, a pretransfer station or subsystem 240, a transfer station or subsystem 250, a precleaning station or subsystem 260, and a cleaning/erase station 270. The photoreceptor 200 of the embodiment shown is a drum, but other forms of photoreceptor could conceivably be used. The photoreceptor (PC) 200 includes a surface 202 of a photoconductor 204 on which an electrostatic charge can be formed. The photoconductor 204 can be mounted or formed on a cylinder or substrate 206 that is mounted for rotation on a shaft 208, such as in the direction of the arrow 209.

The charging station 210 of embodiments includes a biased charging roller 212 that charges the photoreceptor 200 using a DC-biased AC voltage supplied by a high voltage power supply (not shown). The biased charging roller 212 includes a surface 214 of an elastomeric layer 215 formed or mounted on an inner cylinder 216, such as a steel cylinder, though any appropriate conducting material could be used. The roller 212 is preferably mounted for rotation with a shaft 218 extending therethrough along a longitudinal axis of the roller 212.

The laser scanning device 220 of embodiments includes a controller 222 that modulates the output of a laser 224, such as a diode laser, whose modulated beam shines onto a rotating mirror or prism 226 rotated by a motor 228. The mirror or prism 226 reflects the modulated laser beam onto the charged PC surface 202, panning it across the width of the PC surface 202 so that the modulated beam can form a line 221 of the image to be printed on the PC surface 202. Exposed portions of the image to be printed move on to the toner deposition station 230, where toner 232 adheres to the exposed regions of the photoconductor. The image regions of the PC, with adherent toner, then pass to the pretransfer station 240 and on to the transfer station 250.

The transfer station 250 includes a biased transfer roller 252 arranged to form a nip 253 on an intermediate transfer belt 111 with the PC 200 for transfer of the toner image onto the intermediate transfer belt 111. In embodiments, the biased transfer roller 252 includes an elastomeric layer 254 formed or mounted on an inner cylinder 256, and the roller 252 is mounted on a shaft 258 extending along a longitudinal axis of the roller 252. The biased transfer roller 252 typically carries a DC potential provided by a high voltage power supply (not shown) The voltage applied to the roller 252 draws the toner image 231 from the photoreceptor surface 202 to the intermediate transfer belt 111. After transfer, the PC surface 202 rotates to the precleaning subsystem 260, then to the cleaning/erasing substation 270, where a blade 272 scrapes excess toner from the PC surface 202 and an erase lamp 274 equalizes the residual charge on the PC surface.

Figure 2:
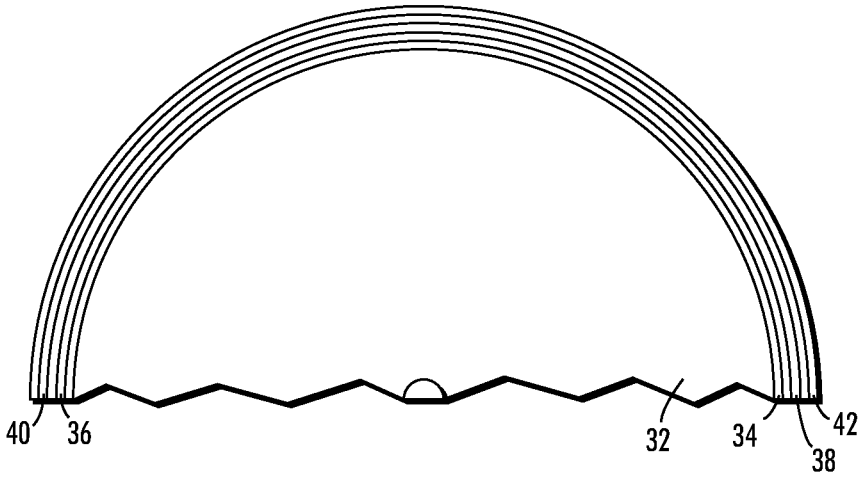
FIG. 2 is a cross-sectional view of an exemplary embodiment of a photoreceptor drum.

An exemplary embodiment of the photoconductor 204 of FIG. 1 of the present disclosure is illustrated in FIG. 2. The substrate 206 supports the other layers. An optional hole blocking layer 34 can also be applied, as well as an optional adhesive layer 36. The photogenerating layer 38 is located between the optional adhesive layer 36 and the charge transport layer 40. An overcoat layer 42 is disposed upon the charge transport layer 40.

Figure 3:
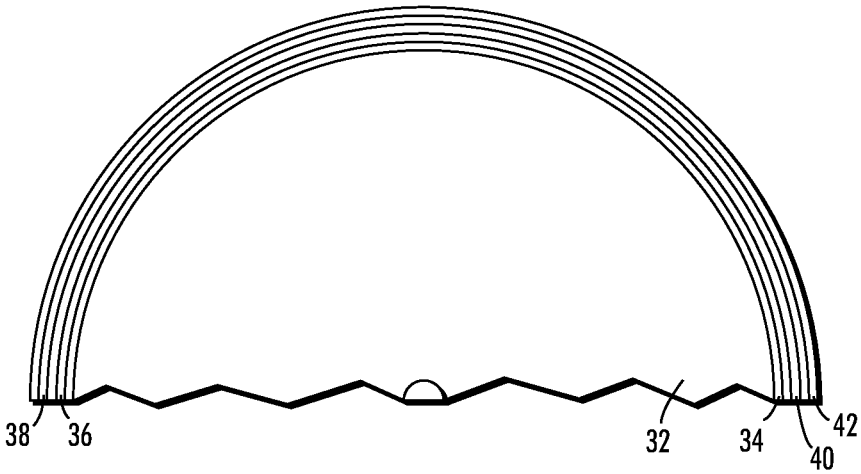
FIG. 3 is a cross-sectional view of an exemplary embodiment of a photoreceptor drum.

Another exemplary embodiment of the photoreceptor drum of the present disclosure is illustrated in FIG. 3. This embodiment is similar to that of FIG. 2, except locations of the charge generating layer 38 and charge transport layer 40 are reversed. Generally, the charge generating layer, charge transport layer, and other layers may be applied in any suitable order to produce either positive or negative charging photoreceptor drums.

The charge transport layer 40 of FIGS. 2 and 3 comprises certain specific charge transport materials which are capable of supporting the injection of photogenerated holes or electrons from the photogenerating layer 38 and allowing their transport through the charge transport layer to selectively discharge the surface charge on the imaging member surface. The charge transport layer, in conjunction with the charge generating layer, should also be an insulator to the extent that an electrostatic charge placed on the charge transport layer is not conducted in the absence of illumination. It should also exhibit negligible, if any, discharge when exposed to a wavelength of light useful in xerography, e.g., about 4000 Angstroms to about 9000 Angstroms. This ensures that when the imaging member is exposed, most of the incident radiation is used in the charge generating layer beneath it to efficiently produce photo generated charges.

The present disclosure relates to embodiments of a photoconductor comprising a supporting substrate, a photogenerating layer, a charge transport layer, and an overcoat layer in contact with and contiguous to the charge transport layer, wherein the overcoat layer is comprised of polyethylene-block-polyethylene glycol copolymer and a charge transport component.

The present disclosure relates to embodiments of a photoconductor comprising an optional supporting substrate, a photogenerating layer, a charge transport layer, an overcoat layer in contact with and contiguous to the charge transport layer, and an overcoat layer comprised of a polyethylene-block-polyethylene glycol copolymer represented by

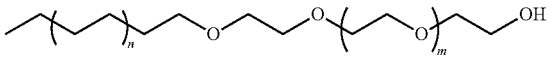

wherein n is from about 10 to about 23, or from about 12 to about 20, or from about 14 to about 18, and m is from about 0 to about 39, or from about 4 to about 30, or from about 10 to about 20, and a charge transport component. The polyethylene-block-polyethylene glycol copolymer is present in the overcoat layer 42 in an amount of from about 1 to about 50 weight percent, or from about 2 to about 40 weight percent, or from about 5 to about 20 weight percent.

The charge transport component of the overcoat layer can be

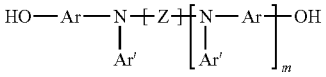

wherein m is zero or 1; Z is selected from the group consisting of at least one of

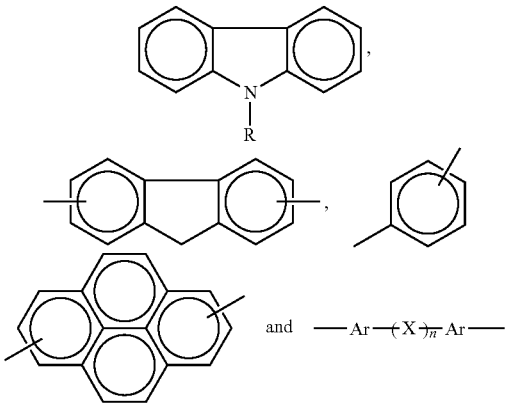

wherein n is 0 or 1; Ar is selected from the group consisting of at least one of

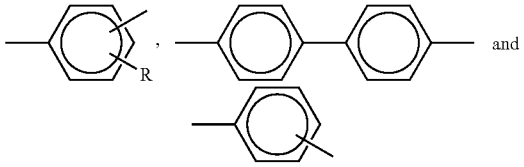

and; Ar' is selected from the group consisting of at least one of

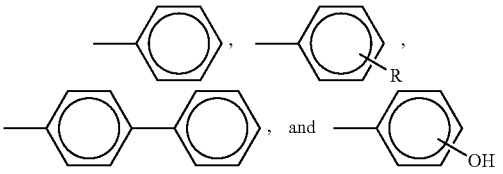

and; X is selected from the group consisting of at least one of

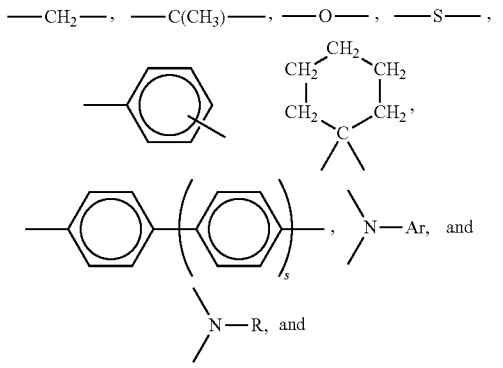

wherein R for each set of structures shown above is selected from the group consisting of at least one of —$CH_3$, —$C_2H_5$, —$C_3H_7$, and —$C_4H_9$; and wherein S is zero, 1 or 2. The charge transport component is present in the overcoat layer 42 in an amount of from about 20 to about 90 weight percent, or from about 30 to about 70 weight percent, or from about 40 to about 60 weight percent.

The overcoat layer 42 further comprises a melamine resin represented by

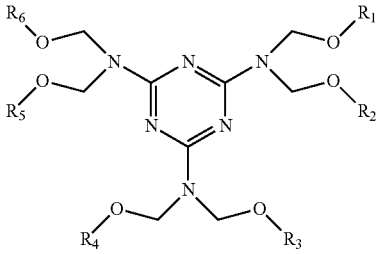

wherein $R_1$, $R_2$, $R_3$, $R_4$, $R_5$ and $R_6$ each independently represents a hydrogen atom or an alkyl chain with, for example, from 1 to about 8 carbon atoms, and more specifically, from 1 to about 4 carbon atoms. The melamine resin is present in the overcoat layer 42 in an amount of from about 1 weight percent to about 70 weight percent, or from about 5 weight percent to about 60 weight percent, or from about 10 weight percent to about 50 weight percent.

Photoconductor Layer Examples

There can be selected for the photoconductors disclosed herein a number of known layers, such as substrates 206, (FIG. 1, 2 or 3) photogenerating generating layers 38 (FIG. 2 or 3) (also referred to as charge generation layers), charge transport layers (CTL) 40, hole blocking layers 34, adhesive layers 36, protective overcoat layers 42, and the like. Examples, thicknesses and specific components of many of these layers include the following.

The thickness of the photoconductor substrate layer 206 depends on various factors, including economical considerations, desired electrical characteristics, adequate flexibility, and the like, thus this layer may be of substantial thickness, for example over 3,000 microns, such as from about 1,000 microns to about 2,000 microns, from about 500 microns to about 1,000 microns, or from about 300 microns to about 700 microns, ("about" throughout includes all values in between the values recited) or of a minimum thickness. In embodiments, the thickness of this layer is from about 75 microns to about 300 microns, or from about 100 microns to about 150 microns. In embodiments, the photoconductor can be free of a substrate; for example, the layer usually in contact with the substrate can be increased in thickness. For a photoconductor drum, the substrate or supporting medium may be of substantial thickness of, for example, up to many centimeters or of a minimum thickness of less than a millimeter. Similarly, a flexible belt may be of a substantial thickness of, for example, about 250 micrometers, or of a minimum thickness of less than about 50 microns, provided there are no adverse effects on the final electrophotographic device.

Also, the photoconductor may in embodiments include a hole blocking layer 34, an adhesive layer 36, and a top overcoat layer 42.

The photoconductor substrate 206 may be opaque, substantially opaque, or substantially transparent, and may comprise any suitable material that, for example, permits the photoconductor layers to be supported. Accordingly, the substrate may comprise a number of known layers, and more specifically, the substrate can be comprised of an electrically nonconductive or conductive material such as an inorganic or an organic composition. As electrically nonconducting materials, there may be selected various resins known for this purpose, including polyesters, polycarbonates, polyamides, polyurethanes, and the like, which are flexible as thin webs. An electrically conducting substrate may comprise any suitable metal of, for example, aluminum, nickel, steel, copper, and the like, or a polymeric material filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like.

In embodiments where the substrate layer 206 is to be rendered conductive, the surface thereof may be rendered electrically conductive by an electrically conductive coating. The conductive coating may vary in thickness depending upon the optical transparency, degree of flexibility desired, and economic factors, and in embodiments this layer can be of a thickness of from about 0.05 micron to about 5 microns.

Illustrative examples of substrates are described herein, and more specifically, supporting substrate layers selected for the photoconductors of the present disclosure comprise a layer of insulating material including inorganic or organic polymeric materials, such as MYLAR®, a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer 38 can contain known photogenerating pigments, such as metal phthalocyanines, metal free phthalocyanines, and more specifically, alkylhydroxyl gallium phthalocyanines, hydroxygallium phthalocyanines, chlorogallium phthalocyanines, perylenes, especially bis(benzimidazo)perylene, titanyl phthalocyanines, and the like, and yet more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume.

The photogenerating composition or pigment is present in the resinous binder composition in various amounts, inclusive of 100 percent by weight based on the weight of the photogenerating components that are present. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer 38 may comprise amorphous films of selenium and alloys of selenium and arsenic, tellurium, germanium, and the like, hydrogenated amorphous silicon and compounds of silicon, and germanium, carbon, oxygen, nitrogen, and the like fabricated by vacuum evaporation or deposition. The photogenerating layer may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

In embodiments, examples of polymeric binder materials that can be selected as the matrix for the photogenerating layer 38 components are known and include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, and acrylonitrile copolymers, poly(vinyl chloride), vinyl chloride and vinyl acetate copolymers, acrylate copolymers, alkyd resins, cellulosic film formers, poly (amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix and thereafter apply the photogenerating layer coating mixture. The processes may include, for example, spraying, dip coating, roll coating, wire wound rod coating, vacuum sublimation, and the like. For some applications, the photogenerating layer 38 may be fabricated in a dot or line pattern. Removal of the solvent of a solvent-coated layer may be effected by any known conventional techniques such as oven drying, infrared radiation drying, air drying, and the like.

The final dry thickness of the photogenerating layer 38 is as illustrated herein, and can be, for example, from about 0.01 micron to about 30 microns after being dried at, for example, about 40° C. to about 150° C. for about 15 minutes to about 90 minutes. More specifically, a photogenerating layer of a thickness, for example, of from about 0.1 micron to about 30 microns, or from about 0.5 microns to about 2 microns can be applied to or deposited on the substrate, on other surfaces in between the substrate and the charge transport layer, and the like. A charge blocking layer or hole blocking layer 34 may optionally be applied to the electrically conductive surface prior to the application of a photogenerating layer 38. When desired, an adhesive layer 36 may be included between the charge blocking or hole blocking layer 34, or and the photogenerating layer 38. Usually, the photogenerating layer 38 is applied onto the blocking layer 34, and a charge transport layer 40 or plurality of charge transport layers are formed on the photogenerating layer 38. This structure may have the photogenerating layer 38 on top of or below the charge transport layer 40.

In embodiments, a suitable known adhesive layer 36 can be included in the photoconductor. Typical adhesive layer materials include, for example, polyesters, polyurethanes, and the like. The adhesive layer thickness can vary and in embodiments is, for example, from about 0.05 micron (500 Angstroms) to about 0.3 micron (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer usually in contact with or situated between the hole blocking layer 34 and the photogenerating layer 38, there can be selected various known substances inclusive of copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 micron to about 0.5 micron. Optionally, this layer may contain effective suitable amounts, for example from about 1 weight percent to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking 34 or undercoat layer for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer 34 can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound containing at least two phenolic groups, such as bisphenol S; and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 nanometers to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer 34 may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport compounds can be included in the charge transport layer 40, which layer generally is of a thickness of from about 5 microns to about 75 microns, and more specifically, of a thickness of from about 10 microns to about 45 microns. Examples of charge transport components are aryl amines of the following formulas/structures

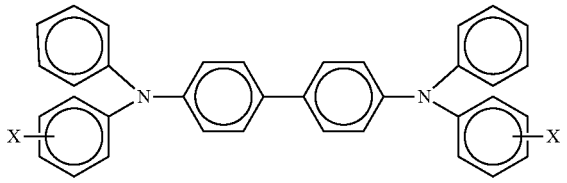

and

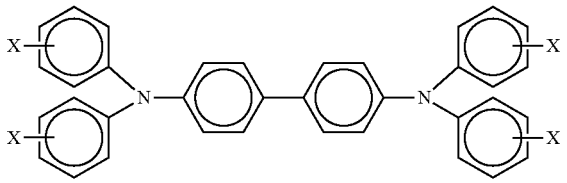

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

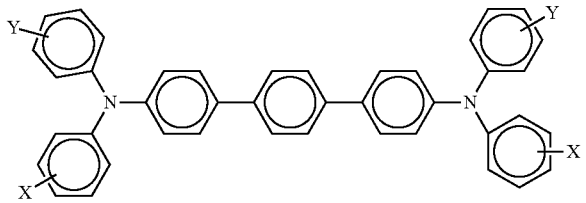

and

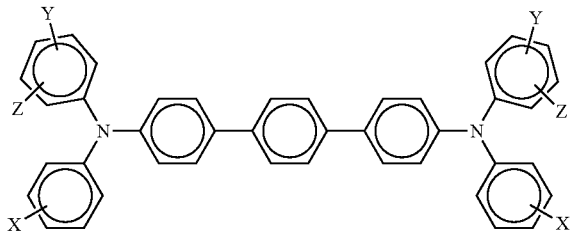

wherein X, Y and Z are independently alkyl, alkoxy, aryl, a halogen, or mixtures thereof.

Alkyl and alkoxy contain, for example, from 1 carbon atom to about 25 carbon atoms, and more specifically, from 1 carbon atom to about 12 carbon atoms, such as methyl, ethyl, propyl, butyl, pentyl, and the corresponding alkoxides. Aryl can contain from 6 carbon atoms to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis (alkylphenyl)-1,1-biphenyl-4,4'-diamine wherein alkyl is selected from the group consisting of methyl, ethyl, propyl, butyl, hexyl, and the like; N,N'diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers 40 include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene) carbonate (also referred to as bisphenol-A-polycarbonate), poly(4,4'-cyclohexylidine-diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000. Generally, the transport layer contains from about 10 percent to about 75 percent by weight of the charge transport material, and more specifically, from about 35 percent to about 50 percent of this material.

The charge transport layer 40 or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules present, for example, in an amount of from about 50 weight percent to about 75 weight percent, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. When appropriate, the charge transport material in the charge transport layer 40 may comprise a polymeric charge transport material or a combination of a small molecule charge transport material and a polymeric charge transport material.

Examples of components or materials optionally incorporated into the charge transport layers 40 or at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVINT™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

A number of processes may be used to mix, and thereafter, apply the charge transport layer 40 or layers coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

The thickness of each of the charge transport layer 40 in embodiments is from about 10 microns to about 70 microns, but thicknesses outside this range may in embodiments also be selected. The charge transport layer 40 should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer 40 to the photogenerating layer 38 can be from about 2:1 to 200:1, and in some instances 400:1. The charge transport layer 40 is substantially nonabsorbing to visible light or radiation in the region of intended use, but is electrically "active" in that it allows the injection of photogenerated holes from the photogenerating layer 38, and allows these holes to be transported through itself to selectively discharge a surface charge on the surface of the active layer. Typical application techniques include spraying, dip coating, roll coating, wire wound rod coating, and the like. Drying of the deposited coating may be effected by any suitable conventional technique, such as oven drying, infrared radiation drying, air drying, and the like.

The photoconductors disclosed herein include a protective overcoat layer 42 (POC) usually in contact with and contiguous to the charge transport layer 40. This POC layer is comprised of polyethylene-block-polyethylene glycol copolymer and a charge transport component. The polyethylene-block-polyethylene glycol copolymer is represented by

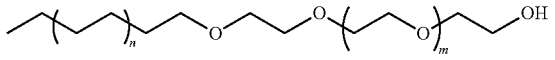

wherein n is from about 10 to about 23, or from about 12 to about 20, or from about 14 to about 18, and m is from about 0 to about 39, or from about 4 to about 30, or from about 10 to about 20, and a charge transport component.

The photoconductor overcoat layer can be applied by a number of different processes inclusive of dispersing the overcoat composition in a solvent system, and applying the resulting overcoat dispersion onto the receiving surface, for example, the top charge transport layer 40 of the photoreceptor to a thickness of, for example, from about 0.5 micron to about 15 microns, or from 2 microns to about 8 microns.

The disclosed polyethylene-block-polyethylene glycol (PE-b-PEG) copolymer is commercially available from BAKER PETROLITE Polymers Group. Commercial PE-b-PEG examples are UNITHOX™ 420 ethoxylate ($M_n$=575, ethylene oxide wt %=20), UNITHOX™ 450 ethoxylate ($M_n$=920, ethylene oxide wt %=50), UNITHOX™ 480 ethoxylate ($M_n$=2,300, ethylene oxide wt %=80), UNITHOX™ 490 ethoxylate ($M_n$=4,600, ethylene oxide wt %=90), UNITHOX™ 550 ethoxylate ($M_n$=1,100, ethylene oxide wt %=50), UNITHOX™ 720 ethoxylate ($M_n$=875, ethylene oxide wt %=20), and UNITHOX™ 750 ethoxylate ($M_n$=1,400, ethylene oxide wt %=50).

The overcoat layer can also include a charge transport material, for example, to improve the charge transport mobility of the overcoat layer. According to various embodiments, the charge transport material can be selected from the group consisting of at least one of (i) a phenolic substituted aromatic amine, (ii) a primary alcohol substituted aromatic amine, and (iii) mixtures thereof.

In embodiments, the charge transport component can be an alcohol-soluble dihydroxy biphenyl diamine such as N,N'-diphenyl-N,N'-bis(3-hydroxyphenyl)-[1,1'-biphenyl]-4,4'-diamine (DHTPD) represented by

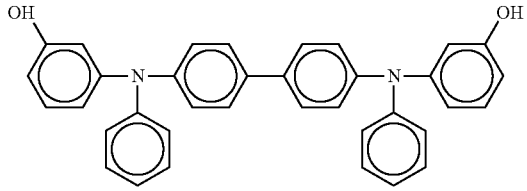

In other embodiments, the charge transport material can be a terphenyl of, for example, an alcohol soluble dihydroxy terphenyl diamine, and the like. An example of a terphenyl charge transporting molecule can be represented by the following formula:

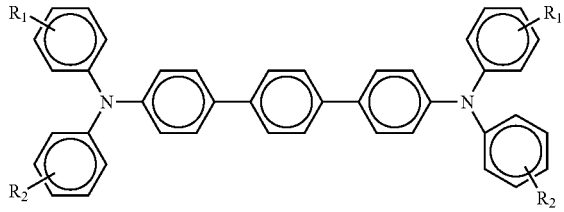

where each $R_1$ is —OH; and $R_2$ is alkyl (—$C_nH_{2n+1}$), where for example, n is from 1 to about 10, from 1 to about 5, or from about 1 to about 6; and aralkyl and aryl groups with, for example, from about 6 carbon atoms to about 30 carbon atoms, or about 6 carbon atoms to about 20 carbon atoms. Suitable examples of aralkyl groups include, for example, —$C_1H_{2n}$-phenyl groups where n is, for example, from about 1 to about 5 or from about 1 to about 10. Suitable examples of aryl groups include, for example, phenyl, naphthyl, biphenyl, and the like. In one embodiment, each $R_1$ is —OH to provide a dihydroxy terphenyl diamine hole transport molecule. For example, where each $R_1$ is —OH and each $R_2$ is —H, the resultant compound is N,N'-diphenyl-N,N'-di[3-hydroxyphenyl]-terphenyl-diamine. In another embodiment, each $R_1$ is —OH, and each $R_2$ is independently an alkyl, aralkyl, or aryl group as defined above. In various embodiments, the charge transport material is soluble in the selected solvent used in forming the overcoat layer.

The overcoat layer 42 further comprises a melamine resin. Examples of melamine resin include highly methylated/butylated melamine formaldehyde resins, such as those commercially available from Cytec Industries, such as CYMEL® 303, 104, MM-100, and the like. These melamine formaldehyde resins exhibit a high degree of alkylation. A nonlimiting example of a suitable methoxymethylated melamine resin is CYMEL® 303 (available from Cytec Industries), which is a methoxymethylated melamine compound with the formula $(CH_3OCH_2)_6N_3C_3N_3$ and as represented by

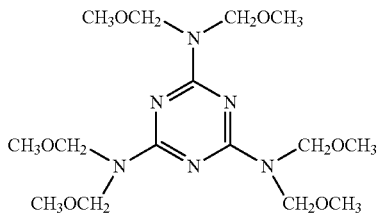

In embodiments, the melamine resin is water-soluble, dispersible or nondispersible. Specific examples of melamine resins include highly alkylated/alkoxylated, partially alkylated/alkoxylated, or mixed alkylated/alkoxylated; methylated, n-butylated or isobutylated; highly methylated melamine resins such as CYMEL® 350, 9370; methylated high imino melamine resins (partially methylolated and highly alkylated) such as CYMEL® 323, 327; partially methylated melamine resins (highly methylolated and partially methylated) such as CYMEL® 373, 370; high solids mixed ether melamine resins such as CYMEL® 1130, 324; n-butylated melamine resins such as CYMEL® 1151, 615; n-butylated high imino melamine resins such as CYMEL® 1158; iso-butylated melamine resins such as CYMEL® 255-10. CYMEL® melamine resins are commercially available from CYTEC Industries, Inc., and yet more specifically, the melamine resin may be selected from the group consisting of methylated melamine resin, methoxymethylated melamine resin, ethoxymethylated melamine resin, propoxymethylated melamine resin, butoxymethylated melamine resin, hexamethylol melamine resin, alkoxyalkylated melamine resins such as methoxymethylated melamine resin, ethoxymethylated melamine resin, propoxymethylated melamine resin, butoxymethylated melamine resin, and mixtures thereof.

Additionally, there may be included in the overcoat layer 42 low surface energy components, such as hydroxyl terminated fluorinated additives, hydroxyl silicone modified polyacrylates, and mixtures thereof. Examples of the low surface energy components, present in various effective amounts, such as from about 0.1 to about 25, from about 0.5 to about 15, from about 1 to about 10 weight percent, are hydroxyl derivatives of perfluoropolyoxyalkanes such as FLUOROLINK® D (M.W. about 1,000 and fluorine content about 62 percent), FLUOROLINK® D10-H (M.W. about 700 and fluorine content about 61 percent), and FLUOROLINK® D10 (M.W. about 500 and fluorine content about 60 percent) (functional group —$CH_2OH$); FLUOROLINK® E (M.W. about 1,000 and fluorine content about 58 percent) and FLUOROLINK® E10 (M.W. about 500 and fluorine content about 56 percent) (functional group —$CH_2(OCH_2CH_2)_nOH$); FLUOROLINK® T (M.W. about 550 and fluorine content about 58 percent) and FLUOROLINK® T10 (M.W. about 330 and fluorine content about 55 percent) (functional group —$CH_2OCH_2CH(OH)CH_2OH$); and hydroxyl derivatives of perfluoroalkanes ($R_fCH_2CH_2OH$, wherein $R_f$=$F(CF_2CF_2)_n$) such as ZONYL® BA (M.W. about 460 and fluorine content about 71 percent), ZONYL® BA-L (M.W. about 440 and fluorine content about 70 percent), ZONYL® BA-LD (M.W. about 420 and fluorine content about 70 percent), and ZONYL® BA-N (M.W. about 530 and fluorine content about 71 percent); carboxylic acid derivatives of fluoropolyethers such as FLUOROLINK® C (M.W. about 1,000 and fluorine content about 61 percent), carboxylic ester derivatives of fluoropolyethers such as FLUOROLINK® L (M.W. about 1,000 and fluorine content about 60 percent), FLUOROLINK® L10 (M.W. about 500 and fluorine content about 58 percent), carboxylic ester derivatives of perfluoroalkanes ($R_fCH_2CH_2O(C{=}OR$, wherein $R_f$=$F(CF_2CF_2)_n$ and R is alkyl) such as ZONYL® TA-N (fluoroalkyl acrylate, R=$CH_2$=CH—, M.W. about 570 and fluorine content about 64 percent), ZONYL® TM (fluoroalkyl methacrylate, R=$CH_2$=$C(CH_3)$—, M.W. about 530 and fluorine content about 60 percent), ZONYL® FTS (fluoroalkyl stearate, R=$C_{17}H_{35}$—, M.W. about 700 and fluorine content about 47 percent), ZONYL® TBC (fluoroalkyl citrate, M.W. about 1,560 and fluorine content about 63 percent), sulfonic acid derivatives of perfluoroalkanes ($R_fCH_2CH_2SO_3H$, wherein $R_f$=$F(CF_2CF_2)_n$) such as ZONY®L TBS (M.W. about 530 and fluorine content about 62 percent); ethoxysilane derivatives of fluoropolyethers such as FLUOROLINK® S10 (M.W. about 1,750 to 1,950); phosphate derivatives of fluoropolyethers such as FLUOROLINK® F10 (M.W. about 2,400 to 3,100); hydroxyl derivatives of silicone modified polyacrylates such as BYK-SILCLEAN® 3700; polyether modified acryl polydimethylsiloxanes such as BYK-SILCLEAN® 3710; and polyether modified hydroxyl polydimethylsiloxanes such as BYK-SILCLEAN® 3720. FLUOROLINK® is a trademark of Ausimont, Inc., ZONYL® is a trademark of E.I. DuPont, and BYK-SILCLEAN® is a trademark of BYK SILCLEAN.

Additionally, there may be included in the overcoat layer 42 an acid catalyst. Examples of acid catalysts include p-toluene sulfonic acid, and include commercially available acid catalysts from CYCAT® such as CYCAT® 600, 4040, and the like. In embodiments, the catalyst is added to the overcoat layer in an amount of from about 0.1 weight percent to about 5 weight percent, or from about 0.3 weight percent to about 3 weight percent, or from about 0.4 weight percent to about 1 weight percent of the overcoat layer.

Any suitable solvent, such as a primary, a secondary or a tertiary alcohol solvent, can be employed for the deposition of the film forming overcoat layer. Typical alcohol solvents include, but are not limited to, for example, tert-butanol, sec-butanol, n-butanol, 2-propanol, 1-methoxy-2-propanol, and the like, and mixtures thereof. Other suitable co-solvents that can be selected for the forming of the overcoat layer such as, for example, tetrahydrofuran, monochlorobenzene, methylene chloride, toluene, xylene and mixtures thereof.

The thickness of the overcoat layer, which can depend upon the abrasiveness of, for example, the bias charging roll, cleaning, for example, blade or web cleaning, development, transfer, for example, with a bias transfer roll, is, for example, from about 1 micron or about 2 microns, from about 10 microns to about 20 microns, and the like. In various embodiments, the thickness of the overcoat layer can be from about 1 micron to about 10 microns. Typical application techniques for applying the overcoat layer over the photoconductive layer can include spraying, dip coating, roll coating, wire wound rod coating, extrusion coating, flow coating, and the like. Drying of the deposited overcoat layer can be effected by any suitable conventional technique such as oven drying, infrared radiation drying, air drying, and the like. The dried overcoat layer of this disclosure should transport charges during imaging.

The polyethylene-block-polyethylene glycol (PE-b-PEG) copolymer is present in the overcoat layer 42 in the form of a particle with a size of from about 50 nanometers to about 1,000 nanometers, or from about 80 nanometers to about 500 nanometers, or from about 100 nanometers to about 300 nanometers.

Primarily for purposes of brevity, the examples of each of the substituents, and each of the components/compounds/molecules, polymers (components) for each of the layers specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 carbon atoms to about 20 carbon atoms, and from 6 carbon atoms to about 36 carbon atoms includes 1, 2, 3, 4, 5, 6, 7, 8, 9, 10, 11, 12, 13, 14, 15, up to 36, or more. Similarly, the thickness of each of the layers, the examples of components in each of the layers, the amount ranges of each of the components disclosed and claimed are not exhaustive, and it is intended that the present disclosure and claims encompass other suitable parameters not disclosed or that may be envisioned.

While embodiments have been illustrated with respect to one or more implementations, alterations and/or modifications can be made to the illustrated examples without departing from the spirit and scope of the appended claims. In addition, while a particular feature herein may have been disclosed with respect to only one of several implementations, such feature may be combined with one or more other features of the other implementations as may be desired and advantageous for any given or particular function.

EXAMPLES

On a 30 mm thick aluminum drum substrate was deposited an undercoat layer comprising zirconium acetylacetonate tributoxide (35.5 parts), γ-aminopropyl triethoxysilane (4.8 parts) and poly(vinylbutyral) BM-S (2.5 parts), which were dissolved in n-butanol (52.2 parts). The resulting solution then was coated by a dip coater onto the aluminum drum substrate and the coating solution layer was preheated at 59° C. for 13 minutes, humidified at 58° C. (dew point=54° C.) for 17 minutes and then dried at 135° C. for 8 minutes. The thickness of the resulting undercoat layer was approximately 1.3 microns.

A photogenerating layer, 0.2 micron in thickness comprising chlorogallium phthalocyanine (Type C) was deposited on the above undercoat layer. The photogenerating layer coating dispersion comprised 2.7 grams of chlorogallium phthalocyanine Type C pigment, 2.3 grams of carboxyl-modified vinyl copolymer, VMCH, available from Dow Chemical Co., 15 grams of n-butyl acetate and 30 grams of xylene. The resulting mixture was mixed in an Attritor mill with about 200 grams of 1 mm Hi-Bea borosilicate glass beads for about 3 hours. The dispersion mixture then was filtered through a 20 micron Nylon cloth filter and the solids content of the dispersion was diluted to about 6 weight percent.

Subsequently, a 26 micron charge transport layer was coated on top of the above photogenerating layer from a solution prepared by dissolving N,N'-diphenyl-N,N-bis(3-methylphenyl)-1,1'-biphenyl-4,4'-diamine (mTBD, 4 grams) and a film-forming polymer binder, PCZ-400 [poly(4,4'-dihydroxy-diphenyl-1-1-cyclohexane carbonate), $M_w$=40,000] available from Mitsubishi Gas Chemical Company, Ltd. (6 grams), in a solvent mixture of 21 grams of tetrahydrofuran (THF) and 9 grams of toluene. The CTL was dried in an oven at about 120° C. for about 40 minutes. The resulting CTL layer had a PCZ-400/mTBD ratio of 60/40.

Comparative Example 1 an overcoat layer was applied to the above charge transport layer. The overcoat layer solution was formed by adding 8.3 grams of CYMEL® 303 (a methylated, butylated melamine-formaldehyde crosslinking agent obtained from Cytec Industries Inc.), 9.7 grams of N,N'-diphenyl-N,N'-bis(3-hydroxyphenyl)-[1,1'-biphenyl]-4,4'-diamine (DHTBD), 0.72 gram of BYK-SILCLEAN° 3700 (low surface energy component, a hydroxylated silicone modified polyacrylate obtained from BYK-Chemie USA), and 0.9 gram of NACURE® XP357 (a blocked acid catalyst obtained from King Industries) in 72 grams of DOWANOL® PM (1-methoxy-2-propanol obtained from the Dow Chemical Company). The resultant overcoat layer was dried in a forced air oven for 40 minutes at 155° C. to yield a highly crosslinked, 4.5 micron thick overcoat layer comprising DHTBD/melamine resin/acid catalyst/low surface energy component in the weight ratio of 45.2/52.8/1/1.

Example 1 an overcoat layer was prepared as in Comparative Example 1 except 0.9 grams of the polyethylene-block-polyethylene glycol copolymer, UNITHOX™ 750 ethoxylate ($M_n$=1,400, ethylene oxide wt %=50) was added to the overcoat layer solution, and then ball milled via Attritor for 10 hours. The resulting 4.5 micron thick overcoat layer comprising DHTBD/melamine resin/polyethylene-block-polyethylene glycol copolymer/acid catalyst/low surface energy component in the weight ratio of 43.0/50.3/4.8/0.95/0.95.

Example 2 an overcoat layer was prepared as in Comparative Example 1 except 1.8 grams of the polyethylene-block-polyethylene glycol copolymer, UNITHOX™ 750 ethoxylate ($M_n$=1,400, ethylene oxide wt %=50) was added to the overcoat layer solution, and then ball milled via Attritor for 10 hours. The resulting 4.5 micron thick overcoat layer comprising DHTBD/melamine resin/polyethylene-block-polyethylene glycol copolymer/acid catalyst/low surface energy component in the weight ratio of 41.1/48/9.1/0.9/0.9.

Electrical Property Testing

The above prepared experimental photoconductors Example 1 and Example 2 were compared to the above prepared control photoconductor Comparative Example 1 which lacked a copolymer of interest. The experimental and control devices were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves (PIDC) from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The photoconductors were tested at surface potentials of 700 volts with the exposure light intensity incrementally increased by regulating a series of neutral density filters; the exposure light source was a 780 nm light emitting diode. The xerographic simulation was conducted in an environmentally controlled light tight chamber at dry conditions (10% relative humidity and 22° C.).

The experimental photoconductors had a residual potential of about 146 V (Example 1), and 164 V (Example 2) as compared to about 170 V for the control photoconductor (Comparative Example 1) that did not contain a copolymer of interest in the overcoat layer. Hence, incorporating a copolymer of interest in the overcoat layer did not adversely impact the electrical properties of the photoconductor and reduced surface potential.

Wear Test

Wear tests of the photoconductors of Comparative Example 1 and Examples 1 and 2 were performed using an in house wear test fixture (biased charging roll with charging of peak to peak voltage of 1.45 kilovolts). The total thickness of each photoconductor was measured via Permascope (Helmut Fischer) before each wear test was initiated. Then the photoconductors were separately placed in the wear fixture for and tested 50 kilocycles. The total photoconductor thickness was measured again with the Permascope, and the difference in thickness was used to calculate wear rate (nanometers/kilocycle) of the photoconductors. The smaller the wear rate, the more wear resistant was the photoconductor. The wear rate data is summarized in Table 1.

TABLE 1

| | Wear Rate (Nanometers/Kilocycle) |
|---|---|
| Control, no copolymer (Comparative Example 1) | 15.3 |
| Experimental, with 4.8 weight percent copolymer (Example 1) | 6.3 |
| Experimental, with 9.1 weight percent copolymer (Example 2) | 8.6 |

When a copolymer of interest was incorporated into the overcoat layer, the wear rate was reduced as compared to control. The wear rate of the bias charging roller with the polyethylene-block-polyethylene glycol copolymer is in the range of from about 5 nanometers/kilocycle to about 10 nanometers/kilocycle.

Torque Test

All the above drums were tested for A zone (85° F. and 80% humidity) torque as follows: all drums were cycled for 30 minutes in a hyper mode test (HMT) setup with a BCR charging device. The ozone evacuation hoses were disconnected during this test to produce maximum corona induction during this test. After cycling, the drum was placed into a Copeland 3545 printer in the black print station. A standard IQ print set was sent to the printer, if the print shuts down or any fault codes appear the drum is said to be a failure. The results were shown in Table 2.

TABLE 2

| | A zone torque test |
|---|---|
| Control, no copolymer (Comparative Example 1) | Failed |
| Experimental, with 4.8 weight percent copolymer (Example 1) | Passed |
| Experimental, with 9.1 weight percent copolymer (Example 2) | Passed |

The Control drum carrying the control overcoat layer failed the torque test. Experimental drums with an overcoat layer containing a copolymer of interest passed the torque test.

It will be appreciated that variants of the above-disclosed and other features and functions or alternatives thereof, may be combined into other different systems or applications. Various presently unforeseen or unanticipated alternatives, modifications, variations, or improvements therein may be subsequently made by those skilled in the art which are also encompassed by the following claims.

What is claimed is:

1. A photoconductor comprising an optional supporting substrate, a photogenerating layer, a charge transport layer, and an overcoat layer in contact with and contiguous to said charge transport layer, and which overcoat layer is comprised of polyethylene-block-polyethylene glycol copolymer and a charge transport component.

2. The photoconductor in accordance with claim 1 wherein the polyethylene-block-polyethylene glycol copolymer is represented by;

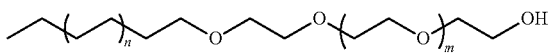

wherein n is from about 10 to about 23 and m is from about 0 to about 39, and is present in the form of a particle of from about 50 nanometers to about 1,000 nanometers.

3. The photoconductor in accordance with claim 1 wherein said charge transport component comprises:

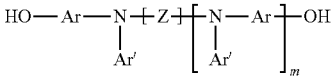

wherein m is zero or 1; Z is selected from the group consisting of at least one of

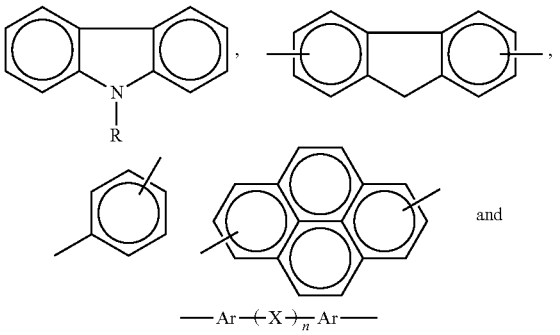

wherein n is 0 or 1; Ar is selected from the group consisting of at least one of

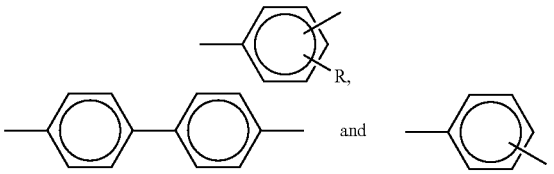

and Ar' is selected from the group consisting of at least one of

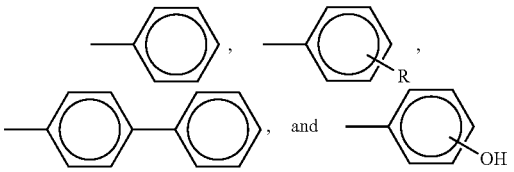

and X is selected from the group consisting of at least one of

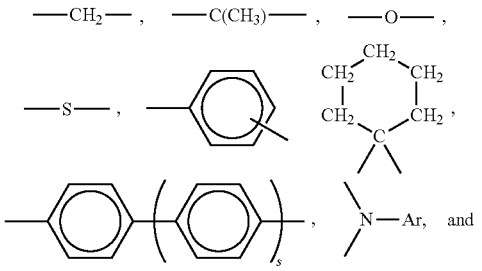

-continued

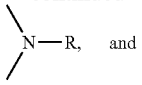

and R is selected from the group consisting of at least one of —$CH_3$, —$C_2H_5$, —$C_3H_7$, and —$C_4H_9$, and wherein S is zero, 1, or 2.

4. The photoconductor in accordance with claim 1 wherein said charge transport component comprises a terphenyl diamine of the following formula

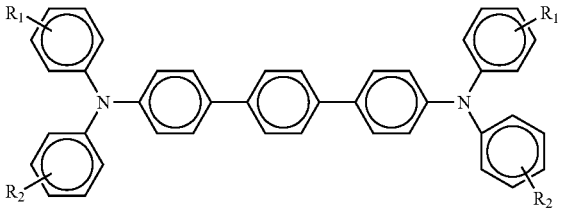

wherein $R_1$ and $R_2$ are independently selected from the group consisting of hydrogen, hydroxyl, alkyl with from 1 carbon atoms to about 12 carbon atoms, arylalkyl with from about 6 to about 36 carbon atoms, and aryl with from about 6 carbon atoms to about 36 carbon atoms groups, wherein at least one of $R_1$ and $R_2$ is not hydrogen.

5. The photoconductor in accordance with claim 1 wherein said charge transport component is selected from the group consisting of at least one of (i) a phenolic substituted aromatic amine, and (ii) a primary alcohol substituted aromatic amine.

6. The photoconductor in accordance with claim 1 wherein said overcoat layer further comprising a melamine resin of the following formula

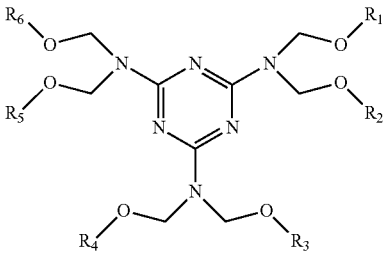

wherein $R_1$, $R_2$, $R_3$, $R_4$, $R_5$ and $R_6$ each independently represents a hydrogen atom or an alkyl chain having from 1 carbon atom to about 8 carbon atoms.

7. The photoconductor in accordance with claim 1 wherein said photogenerating layer is comprised of a photogenerating component, and a polymer binder.

8. The photoconductor in accordance with claim 1 wherein said charge transport layer comprises of aryl amine molecules, and which aryl amines are of the formula

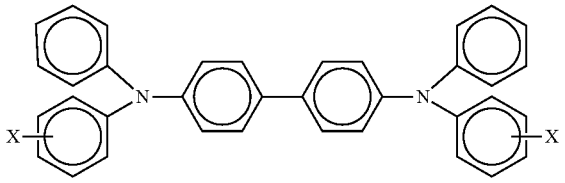

-continued and

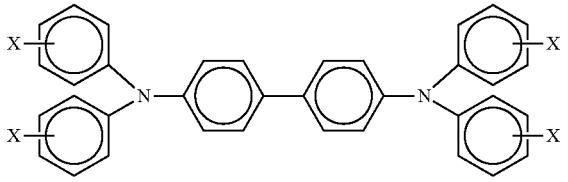

wherein X is selected from the group consisting of alkyl, alkoxy, aryl, and halogen, and mixtures thereof.

9. The photoconductor in accordance with claim 1 wherein said charge transport layer comprises;

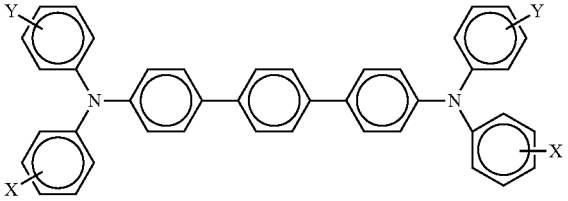

wherein each X and Y is independently selected from the group consisting of at least one of alkyl, alkoxy, aryl, and halogen.

10. The photoconductor in accordance with claim 1 wherein said charge transport layer contains a component selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis (4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terp-henyl]-4,4"-diamine, N,N'-bis(4-butylphenyl)-N,N'-bis-(2,5-dimethylphenyl)-[p-terphenyl]-4,4"-1-diamine, and N,N'-diphenyl-N,N'-bis(3-chlorophenyl)-[p-terphenyl]-4,4"-diamine, and mixtures thereof.

11. The photoconductor in accordance with claim 1 wherein said photogenerating layer is comprised of at least one of a metal phthalocyanine, metal free phthalocyanine, a titanyl phthalocyanine, a halogallium phthalocyanine, a hydroxygallium phthalocyanine, a perylene, or mixtures thereof.

12. A photoconductive member comprised in sequence of a substrate, a photogenerating layer, and at least one charge transport layer comprised of at least one charge transport component, and wherein said photogenerating layer is comprised of at least one photogenerating pigment, and an overcoat layer in contact with and contiguous to said charge transport layer, and is comprised polyethylene-block-polyethylene glycol copolymer and a charge transport component.

13. The photoconductor in accordance with claim 12 wherein the polyethylene-block-polyethylene glycol copolymer is represented by;

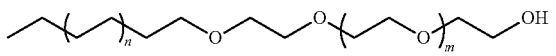

wherein n is from about 10 to about 23 and m is from about 0 to about 39, and is present in the form of a particle of from about 50 nanometers to about 1,000 nanometers.

14. The photoconductor in accordance with claim 12 further including a hole blocking layer and an adhesive layer.

15. A photoconductor comprising a supporting substrate, a photogenerating layer, a hole transport layer, and wherein said photogenerating layer is comprised of at least one photogenerating pigment, and wherein said photogenerating layer and said hole transport layer include a resin binder; said photogenerating layer is situated between said substrate and said hole transport layer; and an overcoat layer in contact with and contiguous to the hole transport layer, and which overcoat layer is comprised of a polyethylene-block-polyethylene glycol copolymer is represented by;

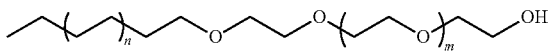

wherein n is from about 10 to about 23 and m is from about 0 to about 39 and a charge transport component.

16. The photoconductor in accordance with claim 15 wherein said charge transport layer is comprised of an aryl amine, and said charge transport component comprises hole transport compounds.

17. The photoconductor in accordance with claim 15 wherein said charge transport layer comprises at least one of

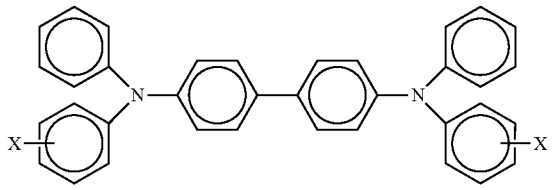

and

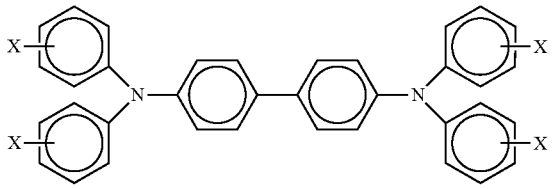

wherein X is selected from the group consisting of alkyl, alkoxy, and halogen.

18. The photoconductor in accordance with claim 15 wherein said charge transport layer contains a component selected from the group consisting of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terp-henyl]-4,4"-diamine, N,N'-bis(4-butylphenyl)-N,N'-bis-(2,5-dimethylphenyl)-[p-terphenyl]-4,4"-1-diamine, and N,N'-diphenyl-N,N'-bis(3-chlorophenyl)-[p-terphenyl]-4,4"-diamine, and mixtures thereof.

19. The photoconductor in accordance with claim 15 wherein said charge transport component is a terphenyl diamine of the following formula

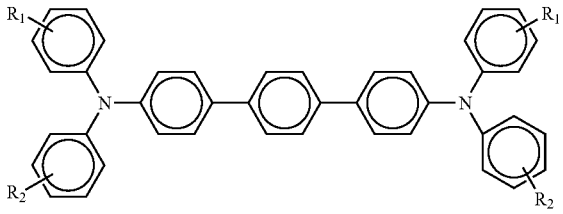

wherein $R_1$ and $R_2$ are independently selected from the group consisting of hydrogen, hydroxyl, alkyl with from 1 carbon atoms to about 12 carbon atoms, arylalkyl with from about 6 to about 36 carbon atoms, and aryl with from about 6 carbon atoms to about 36 carbon atoms, wherein at least one of $R_1$ and $R_2$ is not hydrogen.

20. The photoconductor in accordance with claim 15 wherein said charge transport component is selected from the group consisting of at least one of (i) a phenolic substituted aromatic amine, and (ii) a primary alcohol substituted aromatic amine, and said photoconductor possesses a BCR wear rate of from about 5 nanometers/kilocycle to about 10 nanometers/kilocycle.

* * * * *